US011470428B2

(12) United States Patent
Khaleghimeybodi et al.

(10) Patent No.: US 11,470,428 B2
(45) Date of Patent: Oct. 11, 2022

(54) PERSONALIZED CALIBRATION OF AN IN-EAR DEVICE

(71) Applicant: Meta Platforms Technologies, LLC, Menlo Park, CA (US)

(72) Inventors: Morteza Khaleghimeybodi, Bothell, WA (US); Pablo Francisco Faundez Hoffmann, Kenmore, WA (US); Antonio John Miller, Woodinville, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 108 days.

(21) Appl. No.: 16/943,517

(22) Filed: Jul. 30, 2020

(65) Prior Publication Data

US 2022/0038832 A1 Feb. 3, 2022

(51) Int. Cl.
*H04R 25/00* (2006.01)

(52) U.S. Cl.
CPC ..... *H04R 25/505* (2013.01); *H04R 25/305* (2013.01); *H04R 25/604* (2013.01); *H04R 2225/025* (2013.01); *H04R 2460/15* (2013.01)

(58) Field of Classification Search
CPC ..... H04R 2225/025; H04R 2460/15; H04R 25/305; H04R 25/505; H04R 25/604; H04R 1/1016; H04R 1/1041; H04R 2460/05; H04R 25/50
See application file for complete search history.

(56) References Cited

U.S. PATENT DOCUMENTS

| | | | |
|---|---|---|---|
| 8,027,481 | B2 | 9/2011 | Beard |
| 2007/0147635 | A1 | 6/2007 | Dijkstra et al. |
| 2013/0218022 | A1 | 8/2013 | Larsen et al. |
| 2013/0343564 | A1 | 12/2013 | Darlington |
| 2018/0255394 | A1 | 9/2018 | Colich |

OTHER PUBLICATIONS

International Search Report and Written Opinion for International Application No. PCT/US2021/043063, dated Jan. 11, 2022, 23 pages.
Chan J., "Estimation of Eardrum Acoustic Pressure and of Ear Canal Length from Remote Points in the Canal," The Journal of the Acoustical Society of America, vol. 87, Issue 3, Mar. 1990, pp. 1237-1247.
Invitation to Pay Additional Fees for International Application No. PCT/US2021/043063, dated Nov. 19, 2021, 18 pages.
(Continued)

*Primary Examiner* — Phylesha Dabney
(74) *Attorney, Agent, or Firm* — Fenwick & West LLP

(57) ABSTRACT

An in-ear device occludes an ear canal of an ear of a user. The in-ear device is configured to be calibrated such that the user perceives audio content as though the in-ear device is not occluding the ear canal. A transducer of the in-ear device presents audio content, and an inner microphone of the in-ear device detects sound pressure data within the ear canal. A controller of the in-ear device determines a blocked sound pressure at the entrance to the ear canal based on sound pressure data from an outer microphone. The controller generates sound filters custom to the user based in part on the detected sound pressure within the ear canal and the blocked sound pressure at the entrance to the ear canal. The controller adjusts audio content using the sound filter, and the transducer presents the adjusted audio content to the user.

17 Claims, 8 Drawing Sheets

(56) References Cited

OTHER PUBLICATIONS

Nishimura R., et al., "Headphone Calibration for 3D-Audio Listening," 3rd International Universal Communication Symposium, Dec. 3, 2009, pp. 205-210.

Takanen M., et al., "Audibility of Coloration Artifacts in HRTF Filter Designs," Conference: 45th International Conference:Applications of Time-Frequency Processing in Audio, Mar. 1, 2012, 9 pages.

PERSONALIZED CALIBRATION OF AN IN-EAR DEVICE

FIELD OF THE INVENTION

The present disclosure generally relates to an in-ear device, and specifically relates to personalized calibration of the in-ear device for a user of the in-ear device.

BACKGROUND

A user may wear a headset configured to play audio content. The headset may be configured to be worn within an ear of the user and provide hear-through (or acoustic transparency) functionality. Generic calibration of the headset may not account for individualized internal and external geometries of the user's ear, thereby affecting a quality of audio content presented by the headset.

SUMMARY

An in-ear device is configured to be calibrated for individual's internal (e.g., ear canal) and external geometries of an ear of a user. The in-ear device, when worn by the user, occludes a portion of an ear canal of an ear of the user. The in-ear device includes a controller that determines the effects of the occlusion of the ear canal on audio content presented by the in-ear device. The in-ear device generates one or more individualized sound filters that remove those effects for the user. The one or more sound filters are applied to audio content that is presented to the user. The user perceives the audio content adjusted by the one or more sound filters as though the in-ear device is not within the ear.

In some embodiments, an in-ear device performs a method for calibrating the in-ear device. Audio content is presented via a transducer of the in-ear device. And the in-ear device occludes an ear canal of an ear of a user. Sound pressure data is detected within the ear canal via a microphone of the in-ear device (e.g., the microphone may be internal). A blocked sound pressure at an entrance to the ear canal is determined using sound pressure data from a microphone of the in-ear device configured to capture sound external to the ear. A sound filter is generated, the sound filter customized to the user based in part on the detected sound pressure within the ear canal and the blocked sound pressure at the entrance to the ear canal. The sound filter is configured to remove effects of the ear canal being occluded on presented audio content. Audio content is adjusted using the sound filter. The adjusted audio content is presented via the transducer to the user. In some embodiments, a server performs at least a portion of the above described method for calibrating the in-ear device.

In some embodiments, an in-ear device performs the calibration described above. The in-ear device comprises a body configured to occlude an ear canal of an ear of a user, a transducer coupled to the body and configured to present audio content, and a plurality of microphones. One of the microphones is configured to detect sound pressure data within the ear canal and a second of the microphones is configured to detect sound external to the ear. The in-ear device further comprises a controller configured to perform the method described above.

In some embodiments, a non-transitory computer readable medium configured to store program code instructions, when executed by a processor, cause the processor to perform steps that result in the calibration of an in-ear device as described above. The processor presents audio content via a transducer of an in-ear device, the in-ear device occluding an ear canal of an ear of a user. The processor detects sound pressure data within the ear canal via a microphone of the in-ear device. The processor determines a blocked sound pressure at the entrance to the ear canal using sound pressure data from a microphone of the in-ear device that is configured to capture sound external to the ear. The processor generates a sound filter customized to the user based in part on the detected sound pressure within the ear canal and the blocked sound pressure at the entrance to the ear canal. The sound filter is configured to remove effects of the ear canal being occluded on presented audio content. The processor adjusts audio content using the sound filter and presents, via the transducer, the adjusted audio content to the user.

Figure 1:
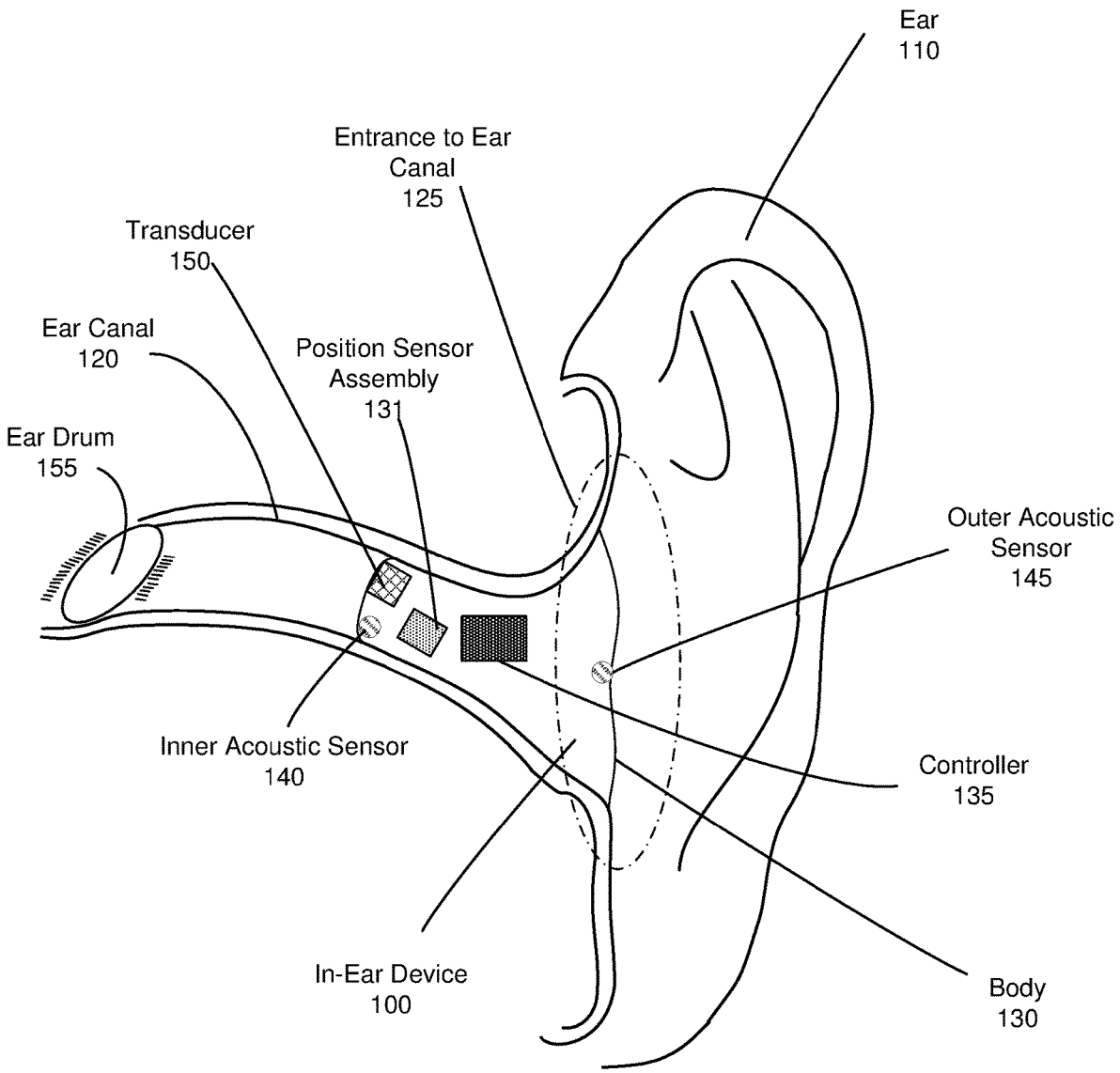
FIG. 1 is a cross-sectional view of an in-ear device within an ear of a user, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Conventional in-ear devices may be configured to present audio content to a user. Positioned within an ear of the user, the conventional in-ear device may occlude a portion of an ear canal of the ear. And wearing the conventional in-ear device may negatively affect how the user perceives audio content presented by the conventional in-ear device. For example, the user may perceive hear through audio content as muffled and/or inaudible due to the occlusion of the ear canal. In some embodiments, inaudible hear through audio content may prevent the user from hearing auditory cues from a local area around the user, which may expose the user to unexpected danger, unintentionally isolating the user from their environment. This is particularly impractical and difficult for hearing impaired users who may use the in-ear device as a hearing aid.

In contrast, to the above, an in-ear device is described herein that is calibrated to remove and/or mitigate some or all of the negative effects described above. The in-ear device includes a body that couples to and/or houses a transducer array, an acoustic sensor array, and a controller, among other components. The controller of the in-ear device calibrates the in-ear device for the user to account for internal and external geometries of the ear. The calibrated in-ear device produces audio content that the user perceives as though the in-ear device is not in the ear. The transducer array presents a calibration signal. The acoustic sensor array detects sound pressure data within the ear canal and at an entrance of the ear canal. The detected sound pressure data when the ear canal is occluded by the in-ear device is termed "blocked sound pressure." Based on the blocked sound pressure at the entrance to the ear canal and within the ear canal, the controller uses a model to estimate the blocked sound pressure at an ear drum of the ear and an "open sound pressure" at the ear drum of the ear. The model may be, e.g., a model with machine learning, analytical expressions, table lookups, numerical simulation, or some combination thereof. The open sound pressure is sound pressure data when the ear canal is unoccluded, without the in-ear device in the ear canal. The controller generates sound filters based on the estimated blocked and open sound pressures at the ear drum and instructs the transducer array to play audio content adjusted by the sound filters. The user perceives audio adjusted by the sound filters as though the ear canal is not occluded by the in-ear device.

The position of the in-ear device may change within the ear canal of the ear of the user. For example, the position of the in-ear device may change when the user exercises. In another example, the user may remove and reposition the in-ear device in the ear canal. Accordingly, there is a need to dynamically recalibrate the in-ear device when there is a change in the position of the in-ear device within the ear canal.

Conventional calibration techniques typically involve placing an acoustic sensor at the ear drum to determine sound pressure. This is unsafe, as an acoustic sensor positioned so close to the ear drum could damage the ear drum. Furthermore, calibrating the in-ear device with an acoustic sensor at the ear drum is impractical and ineffective for dynamic calibration.

The calibration of the in-ear device described herein occurs without an acoustic sensor physically placed at the ear drum of the ear, ensuring safe calibration of the in-ear device. The in-ear device also detects changes in positions within the ear canal of the ear and regenerates sound filters accordingly, enabling dynamic calibration. The user perceives audio content adjusted by the sound filters as though the in-ear device is not occluding the ear canal, resulting in a safer, immersive, and improved auditory experience while wearing the in-ear device.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset (e.g., head-mounted display (HMID) and/or near-eye display (NED)) connected to a host computer system, a standalone headset, a mobile device or computing system, or any other hardware platform capable of providing artificial reality content to one or more viewers.

Overview of the In-Ear Device

FIG. 1 is a cross-sectional view of an in-ear device 100 within an ear 110 of a user, in accordance with one or more embodiments. The in-ear device 100, positioned within a portion of an ear canal 120 of the ear 110 of the user, presents audio content to the user. The in-ear device 100 is configured to be calibrated such that the in-ear device 100 eliminates and/or mitigate effects of the ear canal 120 being occluded on audio content being presented to the user. The in-ear device 100 includes a body 130, an acoustic sensor assembly, a transducer assembly, and a controller 135. In some embodiments, the in-ear device 100 may additionally include a position sensor assembly 131. The in-ear device 100 also includes circuitry components that powers the in-ear device 100 (not shown in FIG. 1). The in-ear device may include components in addition to and/or other than those described herein.

The body 130 houses and/or couples to other components of the in-ear device 100. For example, the body 130 houses and/or couples to the acoustic sensor assembly, the transducer assembly, and the controller 135. In some embodiments, the body 130 is configured to fit, at least partially, within the ear canal 120 of the ear 110. A portion of the ear canal 125 may remain occluded by the body 130. For example, a portion of the body 130 may protrude out of an entrance to the ear canal 125 of the user's ear 110. In some embodiments, the entirety of the body 130 is configured to fit within the ear canal 120 of the ear 110. The body 130 may be made of foam, silicone, plastic, rubber, some other flexible and comfortable material, or some combination thereof. The body 130 may conform to a shape of the user's ear 110 and the ear canal 120.

The acoustic sensor assembly is configured to detect sound. The acoustic sensor assembly includes a plurality of acoustic sensors, including one or more inner acoustic sensors (e.g., an inner acoustic sensor 140) and one or more outer acoustic sensors (e.g., an outer acoustic sensor 145). The inner acoustic sensors detect sound pressure within the ear canal 120 of the ear 110. In some embodiments, the inner acoustic sensors detect sound pressure of audio content presented by the transducer assembly. The inner acoustic sensors may be coupled to a portion of the body positioned within the ear canal 120 of the ear 110 (e.g., as the inner acoustic sensor 140 is shown in FIG. 1). Positions of inner acoustic sensors may vary from what is shown in FIG. 1. The outer acoustic sensors detect sound pressure data at the entrance to the ear canal 125 by capturing sound produced external to the ear 110. For example, sound produced external to the ear 110 may be sound emitted by sound sources in a local area surrounding the user. The outer acoustic sensors may be coupled to a portion of the body 130 positioned proximate to the entrance to the ear canal 125 (e.g., as the outer acoustic sensor 145 is shown in FIG. 1). Positions of the outer acoustic sensors may vary from what is shown in FIG. 1. Each of the inner acoustic sensors and outer acoustic sensors may be acoustic wave sensors, microphones, accelerometers, or similar sensors that are suitable for detecting sound pressure. In some embodiments, the acoustic sensor assembly includes a subset of and/or additional acoustic sensors to those described herein.

The transducer assembly produces audio content for the user based on instructions from the controller 135. The transducer assembly includes one or more transducers (e.g., the transducer 150). The transducers may be speakers that produce audio content via air conduction and direct the audio content to an ear drum 155 of the user's ear 110. With air conduction, each transducer generates airborne acoustic pressure waves, causing the ear drum 155 to vibrate, which a cochlea of the user's ear 110 perceives as sound. The transducers may produce audio content based in part on the sound pressure detected by the inner acoustic sensor 140 and the outer acoustic sensor 145. In some embodiments, the transducers may be instructed by the controller 135 to produce amplified, attenuated, augmented, and/or filtered sound from a local area surrounding the user. The transducers are coupled to and/or within a portion of the body 130 positioned within the ear canal 120 (e.g., as shown by the transducer 150 in FIG. 1). Positions of the transducers may vary from what is shown in FIG. 1.

The position sensor assembly 131 detects changes in position of the in-ear device 100 within the ear canal 120. Changes in position may occur when the in-ear device 100 is removed and replaced in the ear canal 120, or when the in-ear device 100 moves due to the user's movement (e.g., due to exercise). The position sensor assembly 131 includes one or more sensors (not shown) that measure changes in position of the in-ear device, such as inertial measurement units (IMUs), gyroscopes, position sensors, or some combination thereof. The position sensor assembly 131 couples to the body 130 and notifies the controller 135 when there is a change in position of the in-ear device 100.

The controller 135 processes information from the acoustic sensor assembly and instructs the transducer assembly to produce audio content. In some embodiments, the controller 135 is configured to calibrate the in-ear device 100 based on the sound pressures detected by the acoustic sensor assembly. The controller 135 may instruct the transducer assembly to produce a calibration signal. The controller 135 then receives, from the acoustic sensor assembly, the detected sound pressure at the entrance to the ear canal 125 and the ear drum 155 in response to the calibration signal. Based on the detected sound pressures, the controller 135 characterizes how the occlusion of the ear canal 120, by the in-ear device 100, impacts audio quality. Accordingly, the controller 135 generates sound filters that, when applied to audio content, eliminate and/or mitigate effects of the in-ear device 100 occluding the ear canal 120 on audio content. The controller 135 instructs the transducer 150 to present audio content adjusted by the sound filters. In some embodiments, the controller 135 receives data from the position sensor assembly 131 indicating that a position of the in-ear device 100 has changed and/or determines that the position of the in-ear device 100 has changed based on sound pressure readings captured from the transducer 150. Accordingly, the controller 135 may recalibrate the in-ear device 100 based on the change in position of the in-ear device 100. The controller 135 may also control the functioning of various other possible electrical components (e.g., a battery, wireless antenna, power transfer unit, digital signal processor, etc.) of the in-ear device 100 that are not shown in FIG. 1 for simplicity. The calibration of the in-ear device 100 is further described with respect to FIGS. 2-4B.

Figure 2:
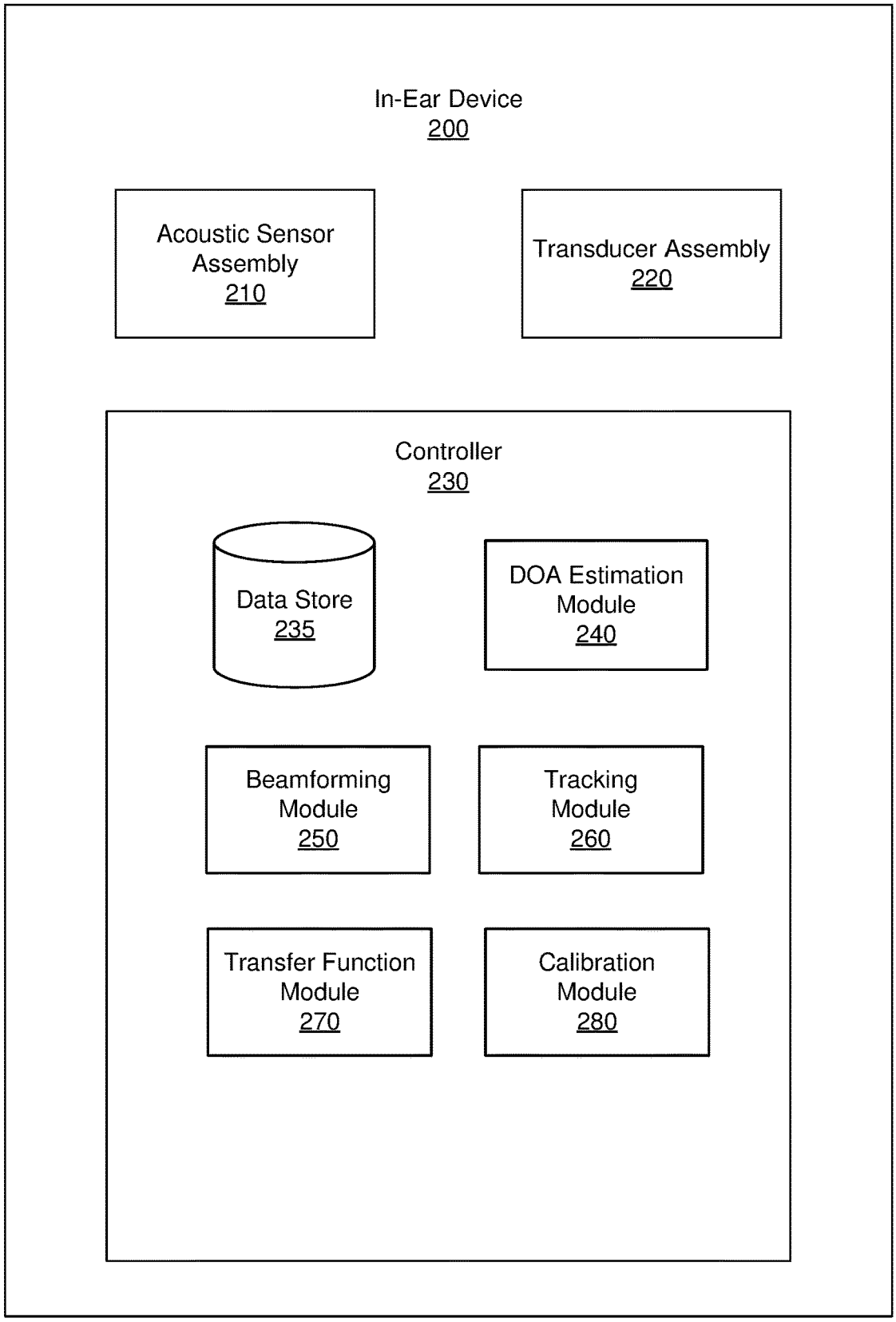
FIG. 2 is a block diagram of an in-ear device, in accordance with one or more embodiments.

FIG. 2 is a block diagram of an in-ear device 200, in accordance with one or more embodiments. The in-ear device 100 may be an embodiment of the in-ear device 200. The in-ear device 200 is positioned within an ear canal of an ear (e.g., the ear canal 120 of the ear 110) of a user and produces audio content. The in-ear device 200 may be calibrated to remove effects of the in-ear device 200 occluding the ear canal on audio content presented by the in-ear device 200. The in-ear device 200 includes an acoustic sensor assembly 210, a transducer assembly 220, and a controller 230. In some embodiments, the in-ear device 200 includes other components than what is shown in FIG. 2. For example, each of the components of the in-ear device 200 may be coupled to and/or within a body (e.g., the body 130). In some embodiments, the user wears two in-ear devices 200 (e.g., one in-ear device 200 in each ear), where one of the in-ear devices 200 calibrates both of the in-ear devices 200. In some embodiments, each of the in-ear devices 200 performs a portion of its own calibration.

The acoustic sensor assembly 210 detects sound pressure. The acoustic sensor assembly 210 includes one or more acoustic sensors, such as an inner acoustic sensor (e.g., the inner acoustic sensor 140) and an outer acoustic sensor (e.g., the outer acoustic sensor 145). The acoustic sensors are configured to capture sound and thereby detect sound pressure. The acoustic sensors may be microphones, accelerometers, or some other sensor that detects acoustic pressure waves. In some embodiments, the inner acoustic sensor is configured to detect sound pressure within the ear canal of the user in response to audio content being produced by the transducer assembly 220. Accordingly, the inner acoustic sensor is positioned within a portion of the body of the in-ear device 200 that is configured to fit a body of the ear canal. The outer acoustic sensor is configured to detect sound pressure at an entrance to the ear canal (e.g., the entrance to the ear canal 125) of the user in response to sound produced by sound sources in a local area surrounding the user.

The transducer assembly 220 presents audio content to the user in accordance with instructions from the controller 230. The transducer assembly 220 includes one or more transducers, such as the transducer 150, which are configured to present audio content to an ear drum (e.g., the ear drum 155) of the user's ear via air conduction. In some embodiments, a subset of the transducers in the transducer assembly 220 are cartilage conduction transducers. Cartilage conduction transducers generate audio content by vibrating cartilage proximate to and/or in the ear of the user, which a cochlea of the ear perceives as sound. As shown in FIG. 1, at least one of the transducers of the transducer assembly 220 may be in a portion of the body of the in-ear device 200 that is positioned within the ear canal. The transducer assembly 220 may be configured to present audio content over a range of frequencies that is perceivable by human hearing, e.g., 20 Hz to 20 kHz. The transducer assembly 220 may receive instructions from the controller 230 present audio content based in part on sound pressure data from the acoustic sensor assembly 210. For example, the transducer assembly 220 may augment, filter, attenuate, and/or amplify sound from the local area surrounding the user. In some embodiments, the transducer assembly 220 presents audio content that has been adjusted to eliminate and/or mitigate effects of the ear canal being occluded (e.g., by the in-ear device 200) on audio content presented by the in-ear device 200.

The controller 230 controls components of the in-ear device 100. The controller 230 may perform other functions in addition to the calibration of the in-ear device 200. The controller 230 includes a data store 235, a DOA estimation module 240, a beamforming module 250, a tracking module 260, a transfer function module 270, and a calibration module 280.

The data store 235 stores data for use by the in-ear device 200. For example, the data store 235 may store the calibration signal, detected sound pressure data from the acoustic sensor assembly 210, sound filters, audio content to present to the user, data on the in-ear device 200's position in the ear, estimated blocked and open sound pressures at the ear drum and/or at the entrance to the ear canal, transfer functions used during calibration, sounds recorded in the local area of the in-ear device 200, head-related transfer functions (HRTFs), transfer functions for one or more of the sensors of the acoustic sensor assembly 210, array transfer functions (ATFs), sound source locations, virtual model of local area, direction of arrival estimates, other data relevant to the in-ear device 200, or some combination thereof.

The DOA estimation module 240 is configured to localize sound sources in the local area based in part on information from the acoustic sensor assembly 210. Localization is a process of determining where sound sources are located relative to the user of the in-ear device 200. The DOA estimation module 240 performs a DOA analysis to localize one or more sound sources within the local area. The DOA analysis may include analyzing the intensity, spectra, and/or arrival time of each sound at the acoustic sensor assembly 210 to determine the direction from which the sounds originated. In some cases, the DOA analysis may include any suitable algorithm for analyzing a surrounding acoustic environment in which the in-ear device 200 is located.

For example, the DOA analysis may be designed to receive input signals from the acoustic sensor assembly 210 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the acoustic sensor assembly 210 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the in-ear device 200 within the local area. The position of the acoustic sensor assembly 210 may be received from an external system (e.g., some other component of a headset, an artificial reality console, a mapping server, a position sensor (e.g., the position sensor 190), etc.). The external system may create a virtual model of the local area, in which the local area and the position of the in-ear device 200 are mapped. The received position information may include a location and/or an orientation of some or all of the in-ear device 200 (e.g., of the acoustic sensor assembly 210). The DOA estimation module 240 may update the estimated DOA based on the received position information.

The beamforming module 250 is configured to process one or more ATFs to selectively emphasize sounds from sound sources within a certain area while de-emphasizing sounds from other areas. In analyzing sounds detected by the acoustic sensor assembly 210, the beamforming module 250 may combine information from different acoustic sensors to emphasize sound associated from a particular region of the local area while deemphasizing sound that is from outside of the region. The beamforming module 250 may isolate an audio signal associated with sound from a particular sound source from other sound sources in the local area based on, e.g., different DOA estimates from the DOA estimation module 240 and the tracking module 260. The beamforming module 250 may thus selectively analyze discrete sound sources in the local area. In some embodiments, the beamforming module 250 may enhance a signal from a sound source. For example, the beamforming module 250 may apply sound filters which eliminate and/or mitigate signals above, below, or between certain frequencies. Signal enhancement acts to enhance sounds associated with a given identified sound source relative to other sounds detected by the acoustic sensor assembly 210.

The tracking module 260 is configured to track locations of one or more sound sources. The tracking module 260 may compare current DOA estimates and compare them with a stored history of previous DOA estimates. In some embodiments, the in-ear device 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The transfer function module 270 generates acoustic transfer functions. Generally, a transfer function is a mathematical function giving a corresponding output value for each possible input value. Based on parameters of the detected sound pressures, the transfer function module 270 may generate one or more acoustic transfer functions associated with the in-ear device.

The acoustic transfer functions may be array transfer functions (ATFs), head-related transfer functions (HRTFs), other types of acoustic transfer functions, or some combination thereof. An ATF characterizes how the microphone receives a sound from a point in space. An ATF includes a number of transfer functions that characterize a relationship between the sound source and the corresponding sound received by the acoustic sensors in the acoustic sensor assembly 210. Accordingly, for a sound source there is a corresponding transfer function for each of the acoustic sensors in the acoustic sensor assembly 210. And collectively the set of transfer functions is referred to as an ATF. Accordingly, for each sound source there is a corresponding ATF. Note that the sound source may be, e.g., someone or something generating sound in the local area, the user, or one or more transducers of the transducer assembly 220. The ATF for a particular sound source location relative to the acoustic sensor assembly 210 may differ from user to user due to a person's anatomy (e.g., ear shape, shoulders, etc.) that affects the sound as it travels to the person's ears. Accordingly, the ATFs of the acoustic sensor assembly 210 are personalized for each user of the in-ear device 200.

In some embodiments, the transfer function module 270 determines one or more HRTFs for a user of the in-ear device 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 270 may determine HRTFs for the user. In some embodiments, the transfer function module 270 may provide information about the user to a remote system. The user may adjust privacy settings to allow or prevent the transfer function module 270 from providing the information about the user to any remote systems. The remote system determines a set of HRTFs that are customized to the user using, e.g., machine learning, and provides the customized set of HRTFs to the in-ear device 200.

The calibration module 280 calibrates the in-ear device 200 for a user wearing the in-ear device 200. To calibrate the in-ear device 200, the calibration module 280 estimates sound pressure at the ear drum of the ear in which the in-ear device 200 is positioned and generates sound filters that remove and/or mitigate effects of the ear canal being occluded by the in-ear device 200 on audio content presented by the in-ear device 200. The user perceives audio content adjusted by the sound filters as though the in-ear device 200 is not in the ear.

The calibration module 280 instructs the transducer assembly 220 to present a calibration signal as a result of an input voltage. The calibration signal may be audio content such as a tone played for an amount of time, a piece of music, and so on. The calibration module 280 receives sound pressure data from an inner acoustic sensor of the acoustic sensor assembly. The received sound pressure data is that of the calibration signal within the ear canal of the ear. In some embodiments, the calibration module 280 generates a first transfer function characterizing the sound pressure data within the ear canal as a function of the input voltage to the transducer assembly 220. The generation of transfer functions is discussed in more detail with respect to FIG. 4. Based on the first transfer function, the calibration module 280 estimates a "blocked sound pressure" at the ear drum of the ear. Blocked sound pressure data is considered sound pressure data when the ear canal is blocked (e.g., by the in-ear device 200).

The calibration module 280 estimates a length of the ear canal using the detected sound pressure within the ear canal. Using a tube transmission model, where the ear canal is modeled as a tube with one closed end and one open end, the calibration module 280 estimates a distance from the inner acoustic sensor of the acoustic sensor assembly to the ear drum. The calibration module 280 adds this estimated distance to a known length of the in-ear device 200, resulting in an estimated length of the ear canal from the entrance to the ear canal to the ear drum. In other embodiments, the calibration module 280 inputs the detected sound pressure within the ear canal into a model configured to output an estimated length of the ear canal. The model may be, e.g., a model with machine learning, analytical expressions, table lookups, numerical simulation, or some combination thereof.

Based on the estimated length of the ear canal, the calibration module 280 determines an "open sound pressure data" at the entrance to the ear canal. The open sound pressure data is considered sound pressure data when the ear canal is unoccluded (e.g., when the in-ear device 200 is not within the ear canal). The calibration module 280 also receives sound pressure data at the entrance to the ear canal from the outer acoustic sensor of the acoustic sensor assembly 210, e.g., the blocked sound pressure at the entrance to the ear canal. The calibration module 280 determines a second transfer function characterizing a ratio of the blocked sound pressure to the open sound pressure at the entrance to the ear canal. Using this second transfer function, the calibration module 280 estimates an open sound pressure at the ear drum of the ear. The detailed description of FIG. 4 further describes the calibration module 280's use of transfer functions to calibrate the in-ear device 200.

Subsequently, the calibration module 280 generates a third transfer function that characterizes a ratio of the open sound pressure at the entrance to the ear canal to the blocked sound pressure at the ear drum. Using this third transfer function, the calibration module 280 generates a gain that, when applied to audio content, results in adjusted audio content that eliminates and/or mitigates effects of the in-ear device 200 occluding the ear canal. The calibration module 280 may generate a sound filter including the gain (may be referred to as an individualized hear-thru filter), apply the sound filter to audio content to generate adjusted audio content, and instruct the transducer assembly 220 to present the adjusted audio content. Accordingly, the calibration module creates the individualized hear-through filter using information collected by an inner acoustic sensor and an outer acoustic sensor and by estimating the corresponding sound pressure at the eardrum for both open and occluded cases. In addition, the sound pressure at the open entrance of the ear-canal is estimated using the collected sound pressure at the blocked entrance of the ear-canal (i.e. using the outer acoustic sensor). The estimation of the sound pressure at the open and occluded ear canal conditions may be based on a model. The model may be, e.g., a model with machine learning, analytical expressions, table lookups, numerical simulation, or some combination thereof. As an example, the model (also referred to as a machined trained model) is trained such that for any given acoustic signature collected at the inner acoustic sensor, a corresponding sound pressure at the eardrum can be estimated for both open and occluded cases. The calibration module 280 may use these data along with the collected sound pressure at the internal and external microphones to create individualized hear-through filters.

Accordingly, the calibration module 280 calibrates the in-ear device 200 for the user. The length of the ear canal, as well as the detected sound pressures within the ear canal and at the entrance to the ear canal may vary for different users. Similarly, the length of the ear canal and the detected sound pressures within the ear canal and at the entrance to the ear canal may vary when the in-ear device 200 changes position within the user's ear. Thus, the calibration module 280 may generate different gains and/or sound filters for each user of the in-ear device 200. In some embodiments, the calibration module 280 may regenerate the gain and/or sound filters when the in-ear device 200 is repositioned in the ear canal.

In some embodiments, the calibration module 280 generates other sound filters for the transducer assembly 220, after the calibration has been performed. In some embodiments, the sound filters cause the audio content to be spatialized, such that the audio content appears to originate from a target region. The calibration module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the calibration module 280 calculates one or more of the acoustic parameters. In some embodiments, the calibration module 280 requests the acoustic parameters from a mapping server (e.g., as described below with regard to FIG. 5). The calibration module 280 provides the sound filters to the transducer assembly 220. In some embodiments, the sound filters may cause positive or negative amplification of sounds as a function of frequency.

In-Ear Device Calibration Process

Figure 3:
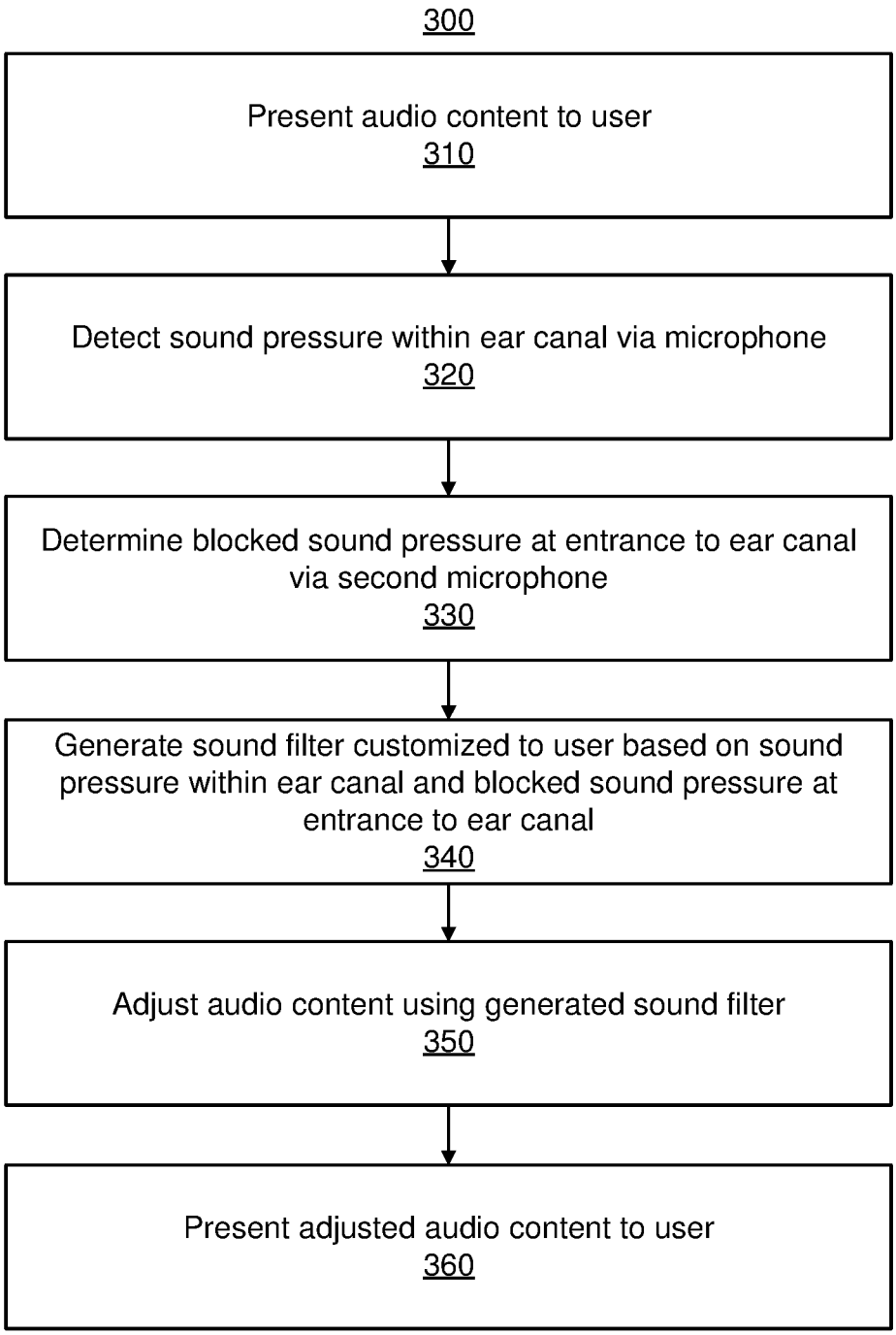
FIG. 3 is a flowchart of a process for calibrating an in-ear device, in accordance with one or more embodiments.

FIG. 3 is a flowchart of a process 300 for calibrating an in-ear device, in accordance with one or more embodiments. The in-ear device may be an embodiment of the in-ear device 200. In some embodiments, the in-ear device may be a hearing aid device. The process shown in FIG. 3 may be performed by components of the in-ear device (e.g., the controller 230 of the in-ear device 200). In other embodiments, other entities may perform some or all of the steps in FIG. 3. Embodiments may include different and/or additional steps, or perform the steps in different orders.

The in-ear device presents 310 audio content to the user via one or more transducers. At least one of the transducers (e.g., the transducer 150) may be positioned within a portion of the in-ear device that is within the ear canal, such that the audio content is presented to an ear drum (e.g., the ear drum 155) of the ear. The audio content may be a calibration signal (e.g., a sound and/or tone played for a period of time) produced by air conduction.

The in-ear device detects 320 sound pressure within the ear canal via a microphone. The microphone may be positioned proximate to the transducer playing the audio content, coupled to the portion of the in-ear device that is within the ear canal (e.g., the inner acoustic sensor 140). In some embodiments, a plurality of microphones detects the sound pressure within the ear canal. In some embodiments, various other acoustic sensors detect the sound pressure within the ear canal instead of and/or in addition to the microphone.

The in-ear device determines 330 a blocked sound pressure at an entrance to the ear canal (e.g., the entrance to the ear canal 125) via a second microphone. The blocked sound pressure refers to sound pressure when the ear canal is blocked (e.g., occluded by the in-ear device). The second microphone may be proximate to the entrance to the ear canal of the ear, coupled to a portion of the in-ear device that protrudes out from the ear canal (e.g., the outer acoustic sensor 145). The second microphone is configured to capture sound external to the ear (e.g., by sound sources in a local area surrounding the user).

The in-ear device generates 340 a sound filter customized for the user based on the sound pressure within the ear canal and the blocked sound pressure at the entrance to the ear canal. To generate the sound filter, the in-ear device estimates and uses an open sound pressure (e.g., the sound pressure when the ear canal is unoccluded) at the ear drum and a blocked sound pressure at the ear drum.

The in-ear device adjusts 350 audio content using the generated sound filter. In some embodiment, adjusting the audio content using the sound filter comprises applying a gain based on an estimated open sound pressure. In some embodiments, the audio content that is adjusted is captured by the second microphone (e.g., from the local area).

The in-ear device presents 360 the adjusted audio content to the user. The user perceives the adjusted audio content as though the in-ear device is not positioned within the ear canal. In effect, the in-ear device's occlusion of the ear canal does not impact audio quality. The in-ear device may present augmented, amplified, attenuated, or otherwise filtered audio content to the user.

In some embodiments, the in-ear device repeats the process 300 to dynamically recalibrate the in-ear device. Dynamic recalibration may occur in response to detecting a change in position of the in-ear device. For example, a position sensor assembly (e.g., including an accelerometer, gyroscope, or some combination thereof) may detect a change in position of the in-ear device that is greater than a threshold. In response, the in-ear device may dynamically recalibrate the in-ear device, e.g., by repeating at least a portion of the process 300, and regenerate the sound filters. Accordingly, the user perceives audio content adjusted by the sound filters as though the in-ear device is not in the user's ear. In some embodiments, the in-ear device repeats the process 300 periodically (e.g., at set intervals of time), and/or in response to detecting a greater than threshold level of acceleration, for example.

FIGS. 4A-E illustrate a calibration process of the in-ear device 100 of FIG. 1A, in accordance with one or more embodiments. The in-ear device 100 is configured to present audio content to an ear 410 of a user. The in-ear device 100 is configured to be positioned within the ear 410 such that it occludes a portion of an ear canal 415 of the ear 410. The calibration process 300 may be an embodiment of the calibration process described herein. The calibrated in-ear device 100 presents audio content such that the user perceives the audio content as though the in-ear device does not occlude the ear canal 415.

Figure 4A:
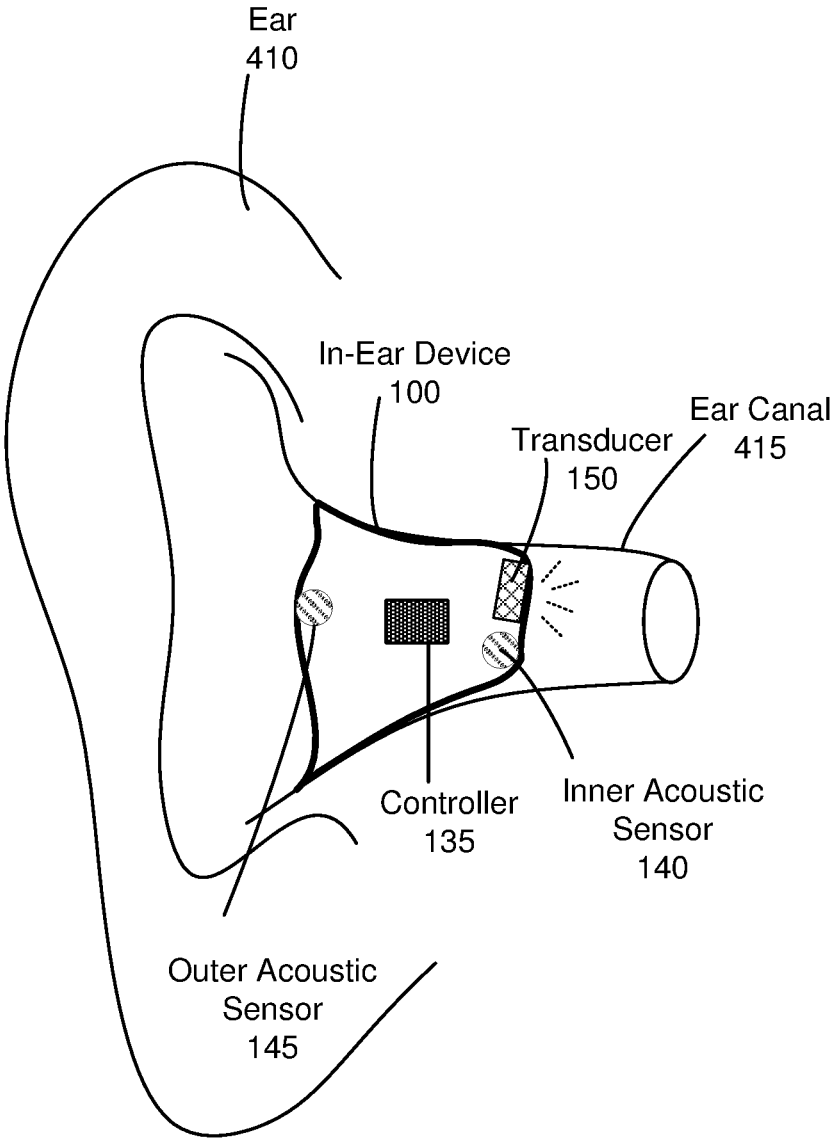
FIGS. 4A-E illustrate a calibration process of the in-ear device of FIG. 1A, in accordance with one or more embodiments.

FIG. 4A illustrates a portion of the calibration process of the in-ear device 100, in accordance with one or more embodiments. The portion of the calibration process shown in FIG. 4A corresponds to steps 310 and 320 of the process 300 of FIG. 3. The controller 135 instructs the transducer 150 to present audio content (e.g., a calibration signal) to the ear 410 of the user. The inner acoustic sensor 140 detects sound pressure data within the ear canal 415 in response to the presented audio content. The controller 135 generates a first transfer function characterizing sound pressure within the ear canal 415 as a function of an input voltage provided to the transducer 150. In Equation 1, below, $TF_1$ is the first transfer function, $P_{ear\ canal}$ represents the sound pressure within the ear canal, and V represents the input voltage to the transducer 150.

$$TF_1 = \frac{P_{ear\ canal}}{V} \tag{1}$$

Figure 4B:
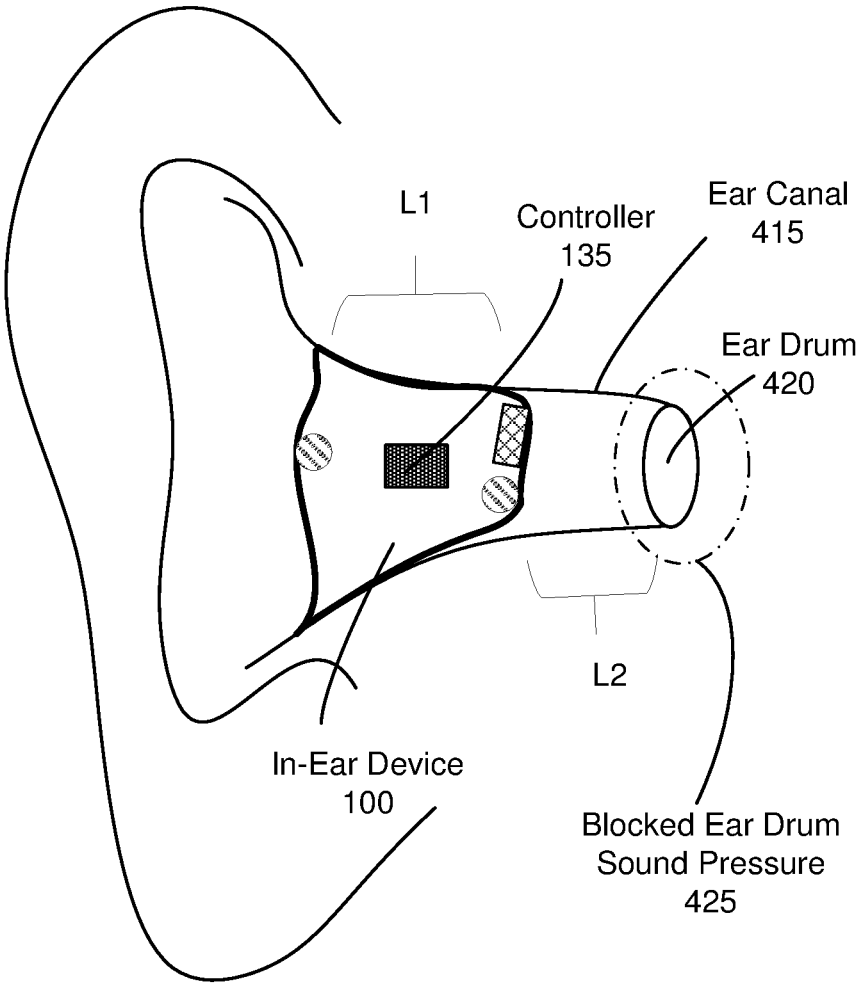

FIG. 4B illustrates another portion of the calibration process of the in-ear device 100, in accordance with one or more embodiments. The portion of the calibration process shown in FIG. 4B corresponds to steps 310 and 320 of the process 300 of FIG. 3. In FIG. 4B, the controller 135 estimates a length of the ear canal 415 using the first transfer function. The controller 135 determines a distance L2, the distance between the in-ear device 100 and the ear drum 420, by modeling the ear canal 415 as a tube that functions as a half-wave resonator. The controller 135 assumes the ear canal 415 transmits sound as a tube would. The controller 135 extracts frequencies of peaks and troughs observed in the first transfer function (see FIG. 4C). In some embodiments, to improve accuracy, the controller 135 takes, as input, sound pressure data at another depth within the ear canal 415 (e.g., measured by another inner acoustic sensor). In some embodiments, the controller 135 generates the model of the ear canal 415 using a model. The model may be, e.g., a model with machine learning, analytical expressions, table lookups, numerical simulation, or some combination thereof. As shown in Equation 2 below, the length of the ear canal 415, $L_{ear\ canal}$, is a length L1 of the in-ear device 100 added to a distance L2 from the in-ear device 100 to the ear drum 420.

$$L_{ear\ canal}=L_1+L_2 \tag{2}$$

Using the tube transmission model of the ear canal 415, the controller 135 also estimates a blocked ear drum sound pressure 425. The blocked ear drum sound pressure 450 is the sound pressure at the ear drum 420 when the ear canal 415 is occluded (e.g., by the in-ear device 100).

Note the in-ear device 100 may determine that the in-ear device 100 is not properly positioned in the ear canal, and notify the user. For example, the in-ear device 100 may not be fully inserted into the ear canal, such that it protrudes a bit. The improper position of the in-ear device 100 can create some acoustic leaks (i.e., low-frequency attenuation, drop in signal, etc.). The controller 135 may determine a presence of acoustic leaks using sound captured from the inner acoustic sensor 140, sound captured from the outer acoustic sensor 145, position data from the position sensor assembly 131 (shown in FIG. 1), or some combination thereof. If the acoustic leaks are detected, the controller 135 determines that the in-ear device is improperly positioned and cause the in-ear device 100 to notify (e.g., via a presented audio message, audio sound, haptic feedback, etc.) the user of the improper placement.

Figure 4C:
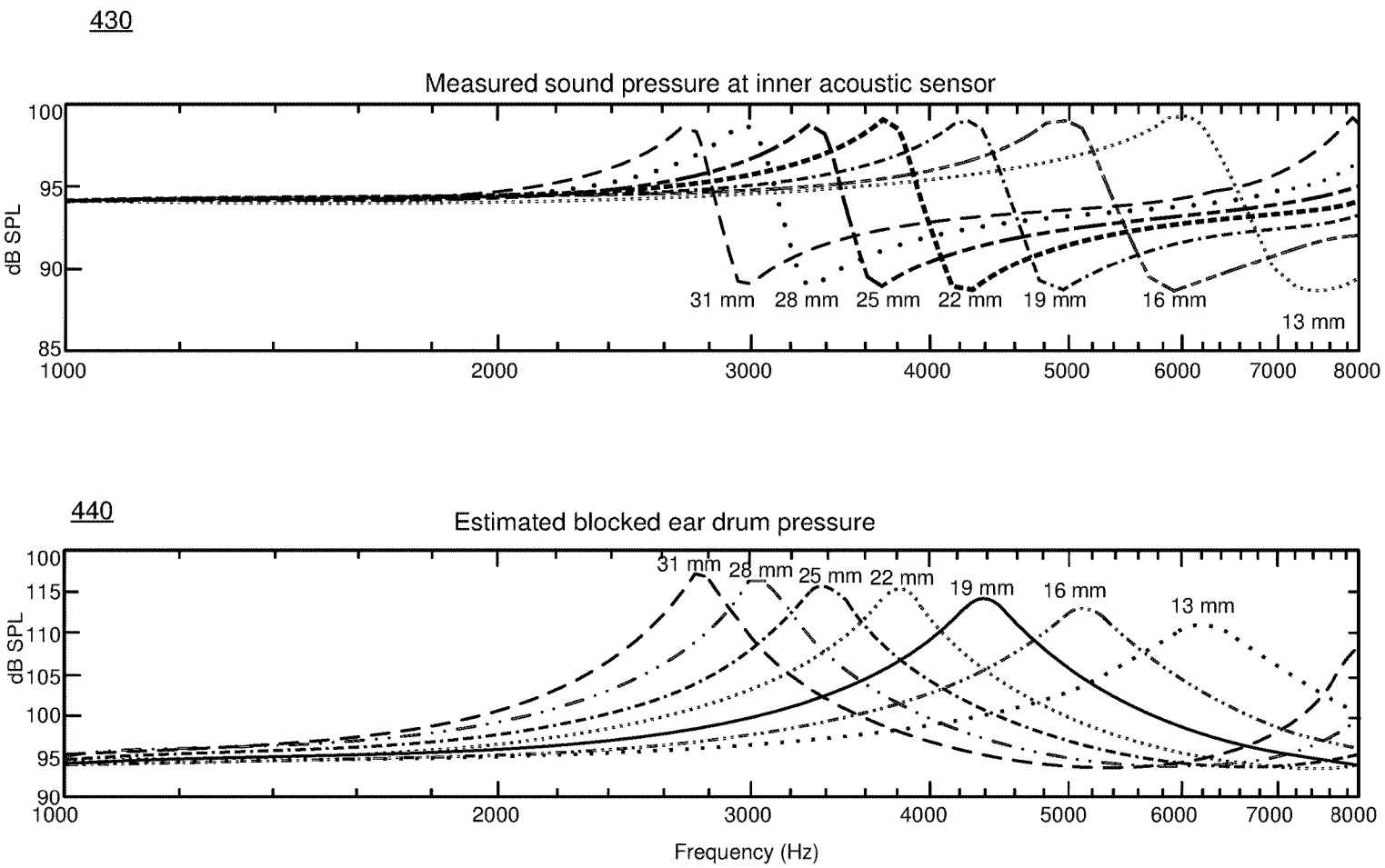

FIG. 4C illustrates graphs 430, 440 from which the distance L2, from the in-ear device 100 to the ear drum 420, and the blocked ear drum sound pressure 425 can be determined, in accordance with one or more embodiments. The inner acoustic sensor 140 measures the sound pressure of the calibration signal produced by the transducer 150 within the ear canal 415, which is plotted as a function of frequency in the graph 430 for different users. Note that the peak (or trough) of plot is located at a different frequency, and that each plot is indicative of a different L2. In some embodiments, the mapping between L2 and the peak and/or trough location (or some other point on a curve) is determined with a model. The model may be trained using user data gathered from many users. In some embodiments, the controller calculates L2 using a model of the ear canal and the peak and/or trough location (or some other point on a curve). Accordingly, for a given user, the controller 135 may use the measured sound pressure of the calibration signal produced by the transducer 150 within the ear canal 415 to determine L2 for that user. For example, when the trough occurs at approximately 5000 Hz, the distance L2 is estimated to be 19 mm.

The graph 440 illustrates estimated blocked ear drum pressure for a plurality of different L2s. For a given user of the in-ear device 100, the controller 135 estimates the sound pressure at the eardrum using a model (e.g., a model with machine learning, analytical expressions, table lookups, numerical simulations, or some combination thereof) and the L2 for that user. The controller 135 may input estimated distance L2 into the model, which is configured to output an estimated blocked ear drum pressure 425 at the eardrum as a function of frequency. For example, when L2 is estimated to be 19 mm, the peak of the blocked ear drum pressure 425 is approximately 115 dB at 4300 Hz.

Figure 4E:
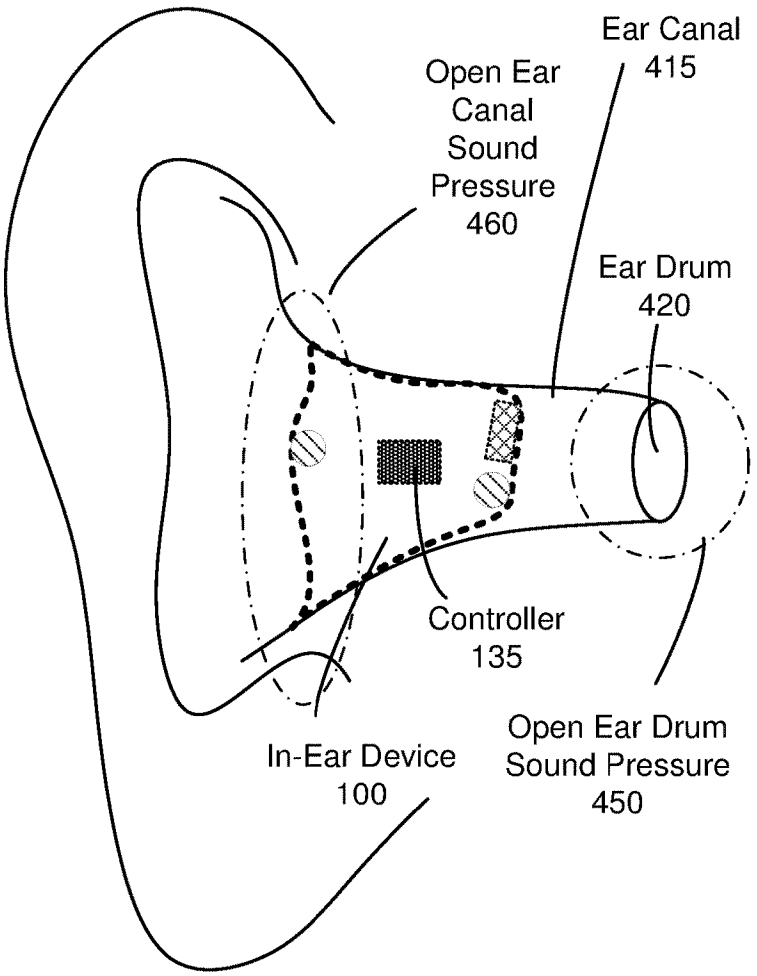
Figure 4D:
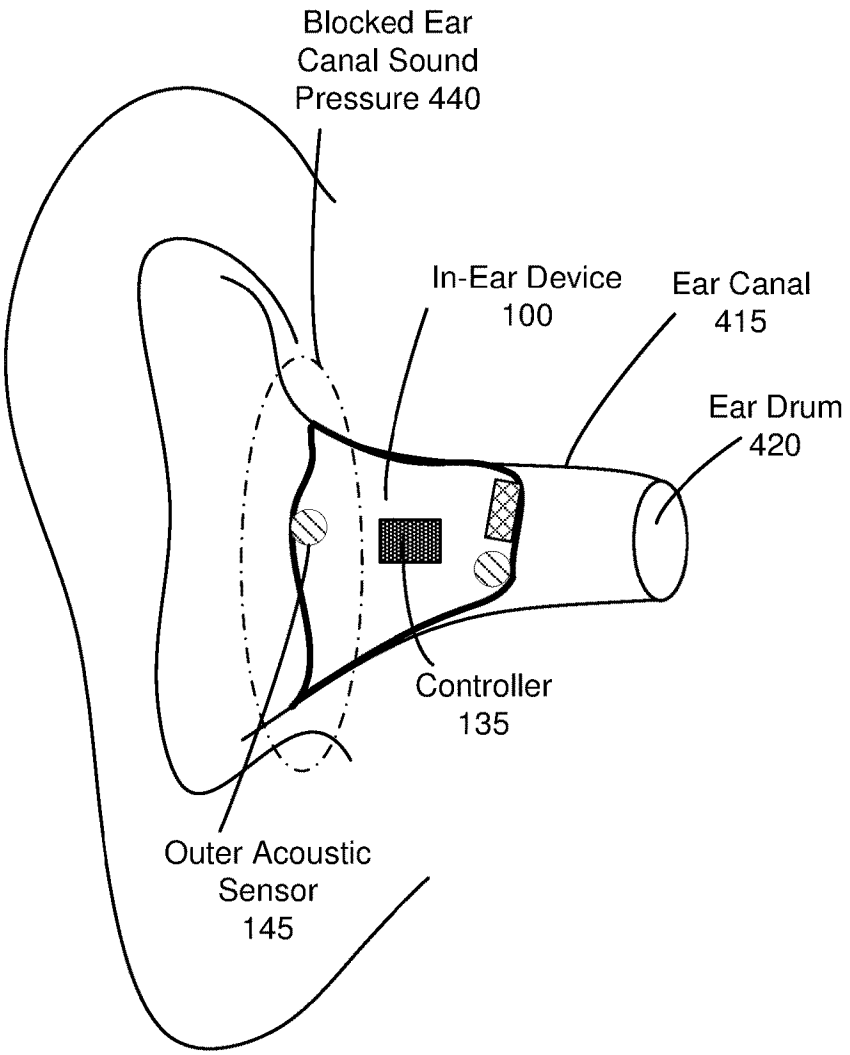

FIG. 4D illustrates another portion of the calibration process of the in-ear device 100, in accordance with one or more embodiments. The portion of the calibration process shown in FIG. 4D corresponds to step 330 of the process 300 of FIG. 3. The outer acoustic sensor 145 measures the sound pressure of captured sound that originates external to the in-ear device 100 (e.g., from a local area around the user). The outer acoustic sensor 145 measures the sound pressure of captured sound at the entrance to the ear canal 415, which is designated a blocked ear canal sound pressure 440. The blocked ear canal sound pressure 440 is the sound pressure at the entrance to the ear canal 415 when the ear canal 415 is occluded (e.g., by the in-ear device 100).

FIG. 4E illustrates another portion of the calibration process of the in-ear device 100, in accordance with one or more embodiments. The portion of the calibration process shown in FIG. 4E corresponds to step 340 of the process 300 of FIG. 3. From the blocked ear canal sound pressure 440 and $L_{ear\ canal}$, the controller 135 estimates an open ear canal sound pressure 460. The open ear canal sound pressure 460 is the sound pressure at the entrance to the ear canal 415 when the ear canal 415 is unoccluded (e.g., the in-ear device 100 is not within the ear 410 of the user). To estimate the open ear canal sound pressure 460, the controller 135 generates a second transfer function, $TF_2$, that characterizes a ratio of the blocked ear canal sound pressure 440 to the open ear canal sound pressure 460. The controller 135 may generate $TF_2$ using, e.g., the tube transmission model and/or a model (a model with machine learning, analytical expressions, table lookups, numerical simulation, or some combination thereof). In Equation 3, $P_{open\ ear\ canal}$ represents the open ear canal sound pressure 460, $P_{blocked\ ear\ canal}$ represents the blocked ear canal sound pressure 440 (e.g., the sound pressure measured by the outer acoustic sensor 145).

$$P_{open\ ear\ canal}=\frac{p_{blocked\ ear\ canal}}{TF_2} \tag{3}$$

The controller 135 generates a third transfer function, $TF_3$, that transfers the open ear canal sound pressure 460 to the ear drum 420. In effect, the third transfer function simulates the open ear canal sound pressure 460 at the ear drum 420. The controller 135 may generate $TF_3$ using, e.g., $L_{ear\ canal}$ and the tube transmission model and/or the model (e.g., machine learning model). In Equation 4 below, $P_{ear\ drum}$ is the pressure at the ear drum 420, and $P_{open\ ear\ canal}$ is the open ear canal sound pressure 460 determined by Equation 3.

$$TF_3=\frac{p_{ear\ drum}}{P_{open\ ear\ canal}}=\frac{(P_{ear\ drum}*TF_2)}{P_{blocked\ ear\ canal}} \tag{4}$$

The controller 135 estimates an open ear drum sound pressure 450 using $TF_3$ and the estimated open ear canal sound pressure 460. The open ear drum sound pressure 450 is the sound pressure at the ear drum 420 when the ear canal 415 is not occluded (e.g., when the in-ear device 100 is not within the ear 410 of the user).

Based on Equations 1-3, the controller 135 generates a gain to apply to audio content. Equation 5 shows the gain G, where M is the sensitivity of the inner acoustic sensor 140, $P_{ear\ drum}$ is the sound pressure at the ear drum 420, $P_{blocked\ ear\ canal}$ is the blocked ear canal sound pressure 440, and $TF_1$ is the first transfer function. V is the input voltage to the transducer 150, and the $P_{blocked\ ear\ drum}$ is the estimated blocked ear drum pressure 425.

$$G=\frac{1}{M}*\frac{P_{open\ ear\ canal}*TF_3}{P_{blocked\ ear\ canal}}*\frac{V}{P_{blocked\ eardrum}} \tag{5}$$

The controller 135 applies the gain determined by Equation 5 to audio content. In some embodiments, the gain is included in a sound filter. The controller instructs the transducer 150 to present audio content adjusted by the sound filter, wherein the user perceives the adjusted audio content as though the ear canal 415 is unoccluded.

Artificial Reality System Environment

Figure 5:
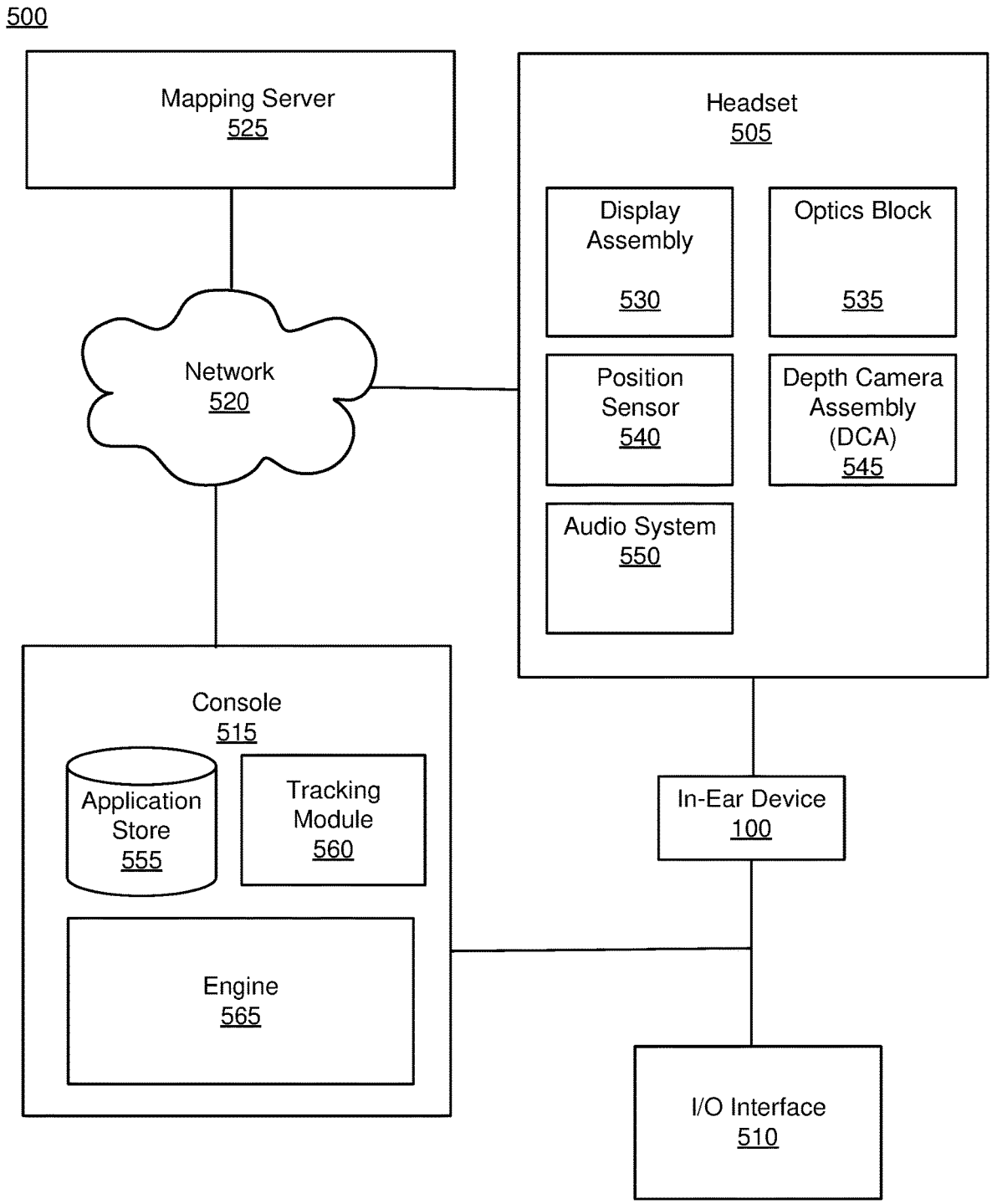
FIG. 5 is a block diagram of a system environment including an in-ear device, in accordance with one or more embodiments.

FIG. 5 is a block diagram of an example artificial reality system environment 500, in accordance with one or more embodiments. The system 500 may operate in an artificial reality environment (e.g., a virtual reality environment, an augmented reality environment, a mixed reality environment, or some combination thereof). The system 500 shown by FIG. 5 includes a headset 505, an input/output (I/O) interface 510 that is coupled to a console 515, a network 520, a mapping server 525, and the in-ear device 100. In some embodiments, the in-ear device 100 may be configured to be used with the artificial reality system. The in-ear device 100 may provide audio content for the artificial reality system. For example, the in-ear device 100 may be a hearing aid for the user. In other embodiments, the in-ear device 100 replaces and/or is used in conjunction with an audio system of the headset 505.

While FIG. 5 shows an example system 500 including one in-ear device 100, one headset 505, and one I/O interface 510, in other embodiments any number of these components may be included in the system 500. For example, there may be two in-ear devices (e.g., each substantially similar to the in-ear device 100) for each ear of a user of the artificial reality system. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The in-ear device 100 presents audio content to a user. In some embodiments, two in-ear devices 100 may present audio content to the user (e.g., one in-ear device 100 in each ear). The in-ear device 100 is configured to fit within an ear canal (e.g., the ear canal 120) of an ear (e.g., the ear 110) of the user. A controller of the in-ear device 100 calibrates the in-ear device 100 to eliminate and/or mitigate effects of the ear canal being occluded by the in-ear device 100. The calibration process (e.g., described with respect to FIGS. 3 and 4A-D) includes modeling the ear canal as a tube that transmits sound, estimating a sound pressure at an ear drum (e.g., the ear drum 155) and an entrance to the ear canal (e.g., the entrance to the ear canal 125) when the ear canal is both blocked and open, and subsequently generating a sound filter.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUs, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 is substantially the same as the audio system 200 describe above. The audio system 550 may comprise one or acoustic sensors, one or more transducers, and an audio controller. The audio system 550 may provide spatialized audio content to the user. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The user may adjust privacy settings to allow or prevent the headset 505 from transmitting information to the mapping server 525. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

One or more components of system 500 may contain a privacy module that stores one or more privacy settings for user data elements. The user data elements describe the user or the headset 505. For example, the user data elements may describe a physical characteristic of the user, an action performed by the user, a location of the user of the headset 505, a location of the headset 505, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 500 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

presenting audio content via a transducer of an in-ear device, the in-ear device occluding an ear canal of an ear of a user;

detecting sound pressure data within the ear canal via a microphone of the in-ear device;

determining a blocked sound pressure at an entrance to the ear canal using sound pressure data from a microphone of the in-ear device that is configured to capture sound external to the ear;

determining a length of the ear canal based on the detected sound pressure within the ear canal;

determining, based on the length of the ear canal, an open sound pressure at the entrance to the ear canal;

determining a transfer function characterizing a ratio of the blocked sound pressure at the entrance to the ear canal to the open sound pressure at the entrance to the ear canal;

generating a sound filter customized to the user based in part on the transfer function, the sound filter configured to remove effects of the ear canal being occluded on presented audio content;

adjusting audio content using the sound filter; and presenting, via the transducer, the adjusted audio content to the user.

2. The method of claim 1, wherein a model is used to determine the length of the ear canal based on the detected sound pressure.

3. The method of claim 2, further comprising:

estimating the open sound pressure at the entrance to the ear canal based on the transfer function and the blocked sound pressure at the entrance to the ear canal; and estimating, based on the estimated open sound pressure at the entrance to the ear canal, an open sound pressure at the ear drum of the ear.

4. The method of claim 3, wherein adjusting audio content using the sound filter comprises applying a gain generated based on the estimated open sound pressure at the ear drum, an estimated blocked sound pressure at the ear drum, and the blocked sound pressure at the entrance to the ear canal.

5. The method of claim 1, wherein the audio content that is adjusted using the sound filter is detected from a local area around the in-ear device and by the microphone of the in-ear device that is configured to capture sound external to the ear.

6. The method of claim 1, further comprising:

responsive to detecting a change in a position of the in-ear device:

regenerating the sound filter;

adjusting audio content using the sound filter; and presenting, via the transducer, the adjusted audio content to the user.

7. The method of claim 1, wherein the in-ear device is a hearing aid.

8. An in-ear device comprising:

a body configured to occlude an ear canal of an ear of a user;

a transducer coupled to the body and configured to present audio content;

a plurality of microphones coupled to the body, wherein one microphone of the plurality of microphones is configured to detect sound pressure data within the ear canal and a second microphone of the plurality of microphones is configured to detect sound external to the ear; and a controller configured to:

determine a length of the ear canal based on the detected sound pressure within the ear canal, determine, based on the length of the ear canal, an open sound pressure at the entrance to the ear canal, determine a transfer function characterizing a ratio of the blocked sound pressure at the entrance to the ear canal to the open sound pressure at the entrance to the ear canal, generate a sound filter customized to the user based in part on the transfer function, the sound filter configured to remove effects of the ear canal being occluded on presented audio content, adjust audio content using the sound filter, and instruct the transducer to present the adjusted audio content to the user.

9. The in-ear device of claim 8, wherein the controller is further configured to use a model to determine the length of the ear canal based on the detected sound pressure.

10. The in-ear device of claim 9, wherein the controller is further configured to:

estimate the open sound pressure at the entrance to the ear canal based on the transfer function and the blocked sound pressure at the entrance to the ear canal; and estimate, based on the estimated open sound pressure at the entrance to the ear canal, an open sound pressure at the ear drum of the ear.

11. The in-ear device of claim 10, wherein adjusting audio content using the sound filter comprises applying a gain generated based on the estimated open sound pressure at the ear drum, an estimated blocked sound pressure at the ear drum, and the blocked sound pressure at the entrance to the ear canal.

12. The in-ear device of claim 8, wherein the audio content that is adjusted using the sound filter is detected from a local area around the in-ear device and by the second microphone of the in-ear device that is configured to detect sound external to the ear.

13. The in-ear device of claim 8, wherein the controller is further configured to:

responsive to detecting a change in a position of the in-ear device:

regenerate the sound filter;

adjust audio content using the sound filter; and present, via the transducer, the adjusted audio content to the user.

14. The in-ear device of claim 8, wherein the in-ear device is a hearing aid.

15. A non-transitory computer readable medium configured to store program code instructions, when executed by a processor, cause the processor to perform steps comprising:

presenting audio content via a transducer of an in-ear device, the in-ear device occluding an ear canal of an ear of a user;

detecting sound pressure data within the ear canal via a microphone of the in-ear device;

determining a blocked sound pressure at the entrance to the ear canal using sound pressure data from a microphone of the in-ear device that is configured to capture sound external to the ear;

determining a length of the ear canal based on the detected sound pressure within the ear canal;

determining, based on the length of the ear canal, an open sound pressure at the entrance to the ear canal;

determining a transfer function characterizing a ratio of the blocked sound pressure at the entrance to the ear canal to the open sound pressure at the entrance to the ear canal;

generating a sound filter customized to the user based in part on the transfer function, the sound filter configured to remove effects of the ear canal being occluded on presented audio content;

adjusting audio content using the sound filter; and presenting, via the transducer, the adjusted audio content to the user.

16. The non-transitory computer readable medium of claim 15, wherein the instructions further cause the processor to perform steps comprising using a model to determine the length of the ear canal based on the detected sound pressure.

17. The non-transitory computer readable medium of claim 15, wherein the instructions further cause the processor to perform steps comprising:

estimating the open sound pressure at the entrance to the ear canal based on the transfer function and the blocked sound pressure at the entrance to the ear canal; and estimating, based on the estimated open sound pressure at the entrance to the ear canal, an open sound pressure at the ear drum of the ear.

* * * * *